US006729105B2

(12) United States Patent
Spatafora et al.

(10) Patent No.: US 6,729,105 B2
(45) Date of Patent: May 4, 2004

(54) UNIT FOR PACKAGING PRODUCTS

(75) Inventors: Mario Spatafora, Bologna (IT); Massimo Fortini, Granarolo Dell'Emilia (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 10/108,497

(22) Filed: Mar. 29, 2002

(65) Prior Publication Data

US 2002/0144486 A1 Oct. 10, 2002

(30) Foreign Application Priority Data

Apr. 4, 2001 (IT) ..... BO2001A0202

(51) Int. Cl.[7] ..... B65B 7/08

(52) U.S. Cl. ..... 53/378.3; 53/377.2; 53/376.5; 53/376.7; 53/377.4

(58) Field of Search ..... 53/377.2, 376.5, 53/376.7, 377.4, 378.3; 493/423, 441, 397, 405

(56) References Cited

U.S. PATENT DOCUMENTS 3,357,156 A * 12/1967 Glogowski ..... 53/372.4
3,629,993 A 12/1971 Chant
4,614,512 A * 9/1986 Capdeboscq ..... 493/441
4,947,617 A 8/1990 Focke et al.
4,979,932 A * 12/1990 Burnside ..... 493/134
5,800,329 A 9/1998 Fager et al.
5,997,459 A * 12/1999 Kruger et al. ..... 493/441
6,210,309 B1 * 4/2001 Smithe et al. ..... 493/438

FOREIGN PATENT DOCUMENTS

| | | |
|---|---|---|
| EP | 0448444 | 9/1991 |
| EP | 0900729 | 3/1999 |
| EP | 1145958 | 10/2001 |

* cited by examiner

*Primary Examiner*—Stephen F. Gerrity
*Assistant Examiner*—Hemant M. Desai
(74) *Attorney, Agent, or Firm*—Davidson Berquist; Klima & Jackson, LLP

(57) ABSTRACT

In a unit by which groups of cigarettes are packed in rigid type packets, the single packet is fashioned from a flat diecut blank folded around the group. An assembly consisting of one blank and one group is directed along a predetermined path and conveyed ultimately into a folding station with the blank still presenting two lateral flaps to be bent over and flattened; the station comprises two folders each presenting a fixed shoe of helical geometry around which a belt is looped slidably and positioned to engage a respective lateral flap as the assembly advances along the relative folding path, the active branch of the loop running in a direction concurrent with that of the advancing assemblies.

16 Claims, 7 Drawing Sheets

69
70
67
70a
69
70a
63a
77
68
70
63
68
72
63a
59
64
63
87
88
T2
87
88a
88b
61
62
88b
D1
82
78
81a
72
78
63b
71
83
64
65
63b
65
71a
81
83
82
30
88a
81a
84
18
71a
71
45
30
17
33
66
16
33

69
70
67
70a
69
70a
77
68
74
78
70
68
85
63a
59
63
78
64
85
88
72
T2
63
87
73
61
62
88b
88b
74
73
73
74
77
87
63b
71
72
65
74
64
63b
88a
71a
65
88a
30
71a
71
18
16
30
45
17
33
66
33
75
76

UNIT FOR PACKAGING PRODUCTS

BACKGROUND OF THE INVENTION

The present invention relates to a unit for packaging products.

In particular, the invention relates to a unit for packaging elements of elongated appearance, typically cigarettes, in packets of the rigid type with a hinged lid, to which direct reference will be made in the present specification albeit with no limitation in scope implied.

Generally considered, cigarette packets of the rigid type with a hinged lid are of substantially rectangular parallelepiped shape and comprise a container, of cupped embodiment, surmounted by a similarly cupped lid hinged to a rear top edge of the container and rotatable thus between an open position and a position in which the container is closed.

The single packet is fashioned generally from a flat diecut blank of substantially rectangular outline referable to a predominating longitudinal axis, presenting two longitudinal crease lines and a plurality of transverse crease lines combining to define a front panel, an end panel and a rear panel compassed between the two longitudinal lines, both for the container and for the lid.

The blank also presents lateral portions that are bent along the aforementioned longitudinal crease lines to form respective side panels constituting the flank faces of the packet.

Packers of conventional design, the machines by which groups of cigarettes are wrapped in rigid packets of the type outlined briefly above, will generally comprise a wrapping wheel rotatable about a substantially horizontal axis and presenting a plurality of peripheral seats by which the blanks are taken up in succession at an infeed station together with the groups of cigarettes, these being ordered previously and wrapped normally in metal foil paper.

In accordance with one wrapping method, each of the aforementioned blanks is placed in the relative seat and advanced along a substantially circular feed path through a succession of stations at which the blank is folded by steps around the relative group of cigarettes.

Thereafter, at an outfeed station of the wrapping wheel, the single blank and the corresponding group of cigarettes partially enveloped by the blank are aligned with gripping elements distributed around the periphery of a transfer wheel disposed with its axis parallel to the axis of the wrapping wheel and rotating in the opposite direction. The function of the transfer wheel is to take up each blank along with the group of cigarettes and, following a given angular movement of the gripping element about a radial axis, to place the partly assembled pack on respective receiving elements afforded by a belt conveyor. The conveyor directs the assembled blanks and groups of cigarettes along a path parallel to the predominating axis of the blank toward a gluing station, a further station at which the lateral portions are folded, and a station from which the completed packets run out.

In particular, the flank faces of the packet are folded by fixed helical elements, located on either side of the belt conveyor in such a manner as to engage and flatten the respective lateral portions of the blank one over the other as the blank and the group of cigarettes advance together along the path followed by the belt conveyor. This means also that an appreciable force must be applied by the fixed helical folders in a direction perpendicular to the flattened lateral portions so that their breasted surfaces will bond after a predetermined quantity of adhesive substance has been interposed between these same surfaces at the gluing station. In effect, the adhesives employed are reasonably quick setting, although not instantaneous, and accordingly there is the need for a substantially uniform pressing action to be exerted on the flank faces of the packet for a given duration.

The fixed helical folders mentioned above betray certain drawbacks.

A first drawback connected with the use of fixed helical folders consists in the fact that there is relative sliding contact between the folders and the packet advancing on the conveyor, also that notable frictional forces are generated between the flank faces and the folders not least as a result of the aforementioned force applied perpendicularly to the flank faces. Besides tending to impede the free movement of the packets along the conveying path, the sliding action and frictional forces can damage the outer surface of the packets through the effects of scoring and rubbing or abrasion.

A second drawback connected with the use of fixed folders, attributable likewise to the perpendicular force applied to the lateral portions of the blank when overlapped to form the flank faces, is that a part of the adhesive substance interposed between these same portions can be forced out. Thus one has residues of adhesive that cling to the surface of the fixed folder, inhibiting the smooth advance of the packets along the conveying path and soiling the outer surface of the finished packet.

It will be evident that in order to remove the aforementioned residues of adhesive and clean up the folder, the machine must be shut down, and this in turn brings disadvantages in terms of costs and lost production.

Another drawback connected with the use of fixed folders is that of the impact which occurs between the folders and the advancing semi-finished packet due to the high velocity of relative motion between the two as the product and the enveloping blank are propelled forward by the belt conveyor.

The prior art embraces belt type folders arranged along the conveying path followed by the blanks, of which the function is to bend the blanks and cause them to assume configurations determined by special crease lines.

Such belt type folders on the other hand present the drawback that they do not allow overlapped portions of the blank to be pressed together.

The object of the present invention is to provide a unit for packaging products in rigid packets, such as will be free of the drawbacks mentioned above.

SUMMARY OF THE INVENTION

The stated object is realized according to the present invention in a unit for packaging products in respective diecut blanks designed to generate packs of substantially parallelepiped appearance, wherein at least one edge portion of the blank is folded in such a way as to establish a respective face of the pack.

The unit disclosed comprises means by which to fold the edge portion as the products advance along a predetermined folding path in a predetermined direction, also runner means forming part of the folding means, capable of movement in a direction concurrent with that of the advancing products and disposed in contact with the edge portion of the blank during the course of the folding step.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
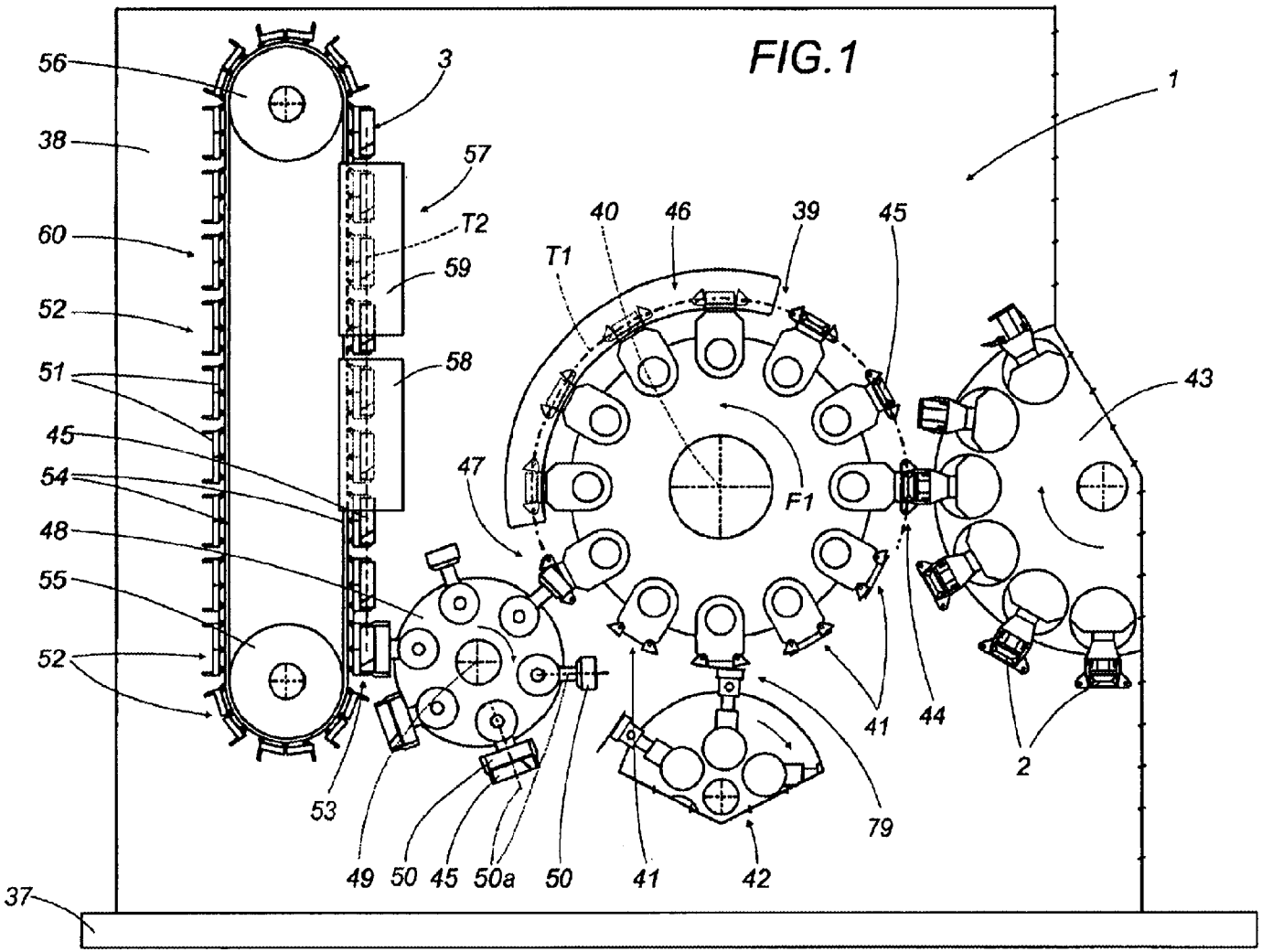
FIG. 1 illustrates a first embodiment of the unit for packaging products in rigid type packets according to the invention, viewed schematically in a side elevation and with certain parts omitted for clarity.
Figure 2:
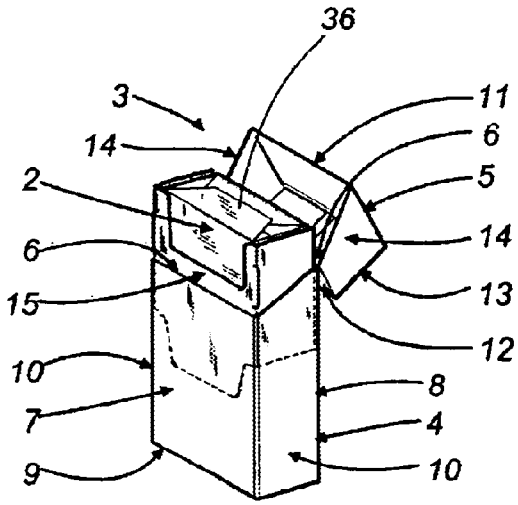
FIG. 2 illustrates a finished packet of rigid type, viewed in perspective.

With reference to FIG. 1 of the accompanying drawings, 1 denotes a unit, in its entirety, for packaging products 2 in packs 3. In particular, the products consist in previously formed groups 2 of cigarettes and the packs 3 consist in packets 3 of rigid type, illustrated to advantage in FIG. 2, presenting the shape substantially of a rectangular parallelepiped and comprising a container 4 of cupped embodiment surmounted by a lid 5, also of cupped embodiment, hinged to an open top end 6 of the container 4 and rotatable thus between an open position and a position in which the container 4 is closed. The container 4 presents a front face 7, a rear face 8, an end face 9 and two flank faces 10, and the lid 5 likewise a front face 11, a rear face 12, an end face 13 and two flank faces 14. Lastly, the packet 3 comprises a reinforcing frame 15 of "U" profile projecting in part from the open end 6 of the container 4 and rigidly associated with the inside of the front face 7 and the flank faces 10 of the selfsame container.

Figure 3:
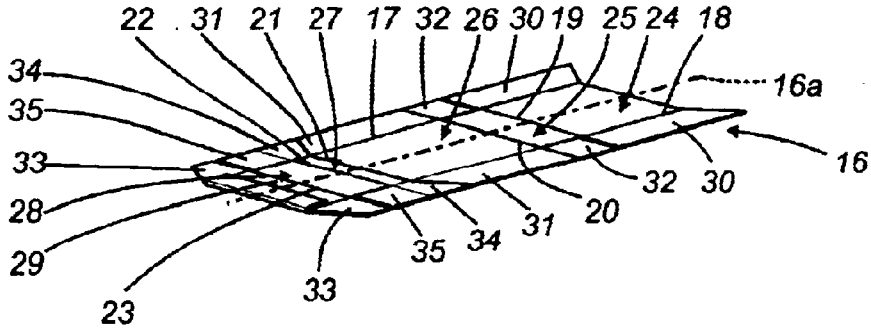
FIG. 3 illustrates a flat diecut blank from which to fashion the packet of FIG. 2, viewed in perspective.

Referring to FIG. 3, the single packet 3 is fashioned from a flat diecut blank 16 exhibiting a substantially rectangular outline referable to a predominating longitudinal axis 16*a* the blank 16 presents two longitudinal crease lines denoted 17 and 18 and a plurality of transverse crease lines denoted 19-20-21-22-23. The transverse lines 19 . . . 23 combine to create a plurality of panels compassed between the two longitudinal lines 17 and 18 and making up both the container 4 and the lid 5. More exactly, in the case of the container 4, the lines denoted 19, 20 and 21 delimit a front panel 24 coinciding with the front face 7, an end panel 25 coinciding with the end face 9 and a rear panel 26 coinciding with the rear face 8. Similarly, in the case of the lid 5, the lines denoted 21, 22 and 23 delimit a rear panel 27 coinciding with the rear face 12, an end panel 28 coinciding with the end face 13 and a front panel 29 coinciding with the front face 11. In addition, the front panel 24 of the container 4 is joined on the two opposite sides to two first front longitudinal lateral flaps 30, whilst the corresponding rear panel 26 is joined on the opposite sides to two second rear longitudinal lateral flaps 31 associated in turn with relative first tongues 32 hinged along the transverse crease line denoted 20 and positioned to reinforce the end panel 25. In like manner, the front panel 29 of the lid 5 is joined on the two opposite sides to two first front longitudinal lateral flaps 33, whilst the rear panel 27 is joined on the opposite sides to two second rear longitudinal lateral flaps 34 associated in turn with relative second tongues 35 hinged along the transverse crease line denoted 22 and positioned to reinforce the end panel 28.

As discernible in FIG. 2 each previously formed group 2 of cigarettes is enveloped in a wrapper 36 of suitable material, generally metal foil.

With reference to FIG. 1, the unit 1 comprises a frame 37 supporting a vertical bulkhead 38, and, cantilevered from the bulkhead, a wrapping wheel 39 rotatable about an axis 40 extending perpendicular to the bulkhead 38 and affording a plurality of seats 41 equispaced angularly around the circular periphery, each designed to accommodate one diecut blank 16 together with a group 2 of cigarettes enveloped by the respective wrapper 36.

The groups 2 of cigarettes and the flat blanks 16 are supplied respectively to the wrapping wheel 39 by a first feed unit 42 and a second feed unit 43, both mounted to the vertical bulkhead 38; the two units 42 and 43 in question are conventional in embodiment and therefore not described further.

The previously formed groups 2 of cigarettes are released by the second feed unit 43 to the wrapping wheel 39 at an infeed station 44 where each group 2 is paired with a respective blank 16, juxtaposed in such a way as to create an assembly 45 composed of one group 2 and a relative blank 16.

The wrapping wheel 39 is rotated in the direction denoted F1 by drive means not illustrated in the drawing, causing the assemblies 45 to describe a circular trajectory T1.

Figure 4:
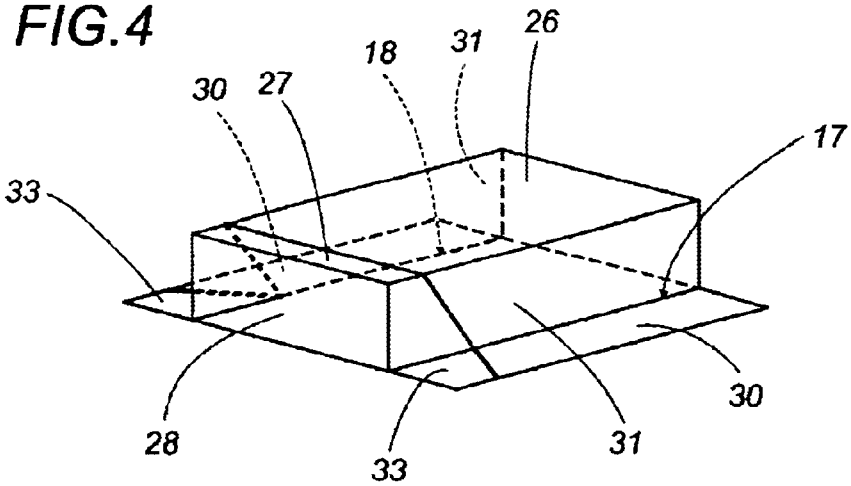
FIG. 4 illustrates a step in the process of folding a rigid type packet around the relative product, viewed in perspective.

Proceeding thus along the circular trajectory T1, the single assemblies 45 will engage in succession with a plurality of folding stations 46 carried by the vertical bulkhead 38. During the course of the passage through these same folding stations 46, the blank 16 is folded gradually around the group 2, by methods that are conventional and therefore require no further description, to the point of assuming the partially enveloping configuration of FIG. 4.

The assemblies 45 are released from the wrapping wheel 39 at an outfeed station 47 and taken up onto a transfer wheel 48, also part of the unit 1, which is cantilevered from the vertical bulkhead 38 and rotatable about an axis 49 parallel to the axis 40 of the wrapping wheel 39.

More exactly, the assemblies 45 are taken up in succession by a plurality of elements 50 equispaced angularly around the periphery of the transfer wheel 48.

The transfer wheel 48 rotates in the opposite direction to that of the wrapping wheel 39, and is timed in such a way that the gripping elements 50 are able to receive the single assemblies 45 from the seats 41 of the wrapping wheel 39 and transfer them to respective pockets 51 of a conveyor 52 at a relative infeed station denoted 53.

The pockets 51 of the conveyor 52 are equispaced along a belt 54 looped around two pulleys of which a first is a driving pulley 55 and a second is a driven pulley 56.

The belt 54 of the conveyor 52 affords an active ascending branch 57 directed toward the wrapping wheel 39, extending along a predetermined conveying and folding path T2 followed by the assemblies 45 occupying the respective pockets 51 as they advance through a gumming station 58 and toward a folding device 59 by which the lateral flaps 30 and 33 of the blank 16 are flattened, then through a further station (not illustrated) from which the finished packets 3 run out.

The belt 54 of the conveyor 52 also affords an inactive descending branch 60 by which the vacant pockets 51 are returned from the runout station (not illustrated) where the finished packets 3 are released, toward the infeed station 53 where the assemblies 45 are received.

Figure 5:
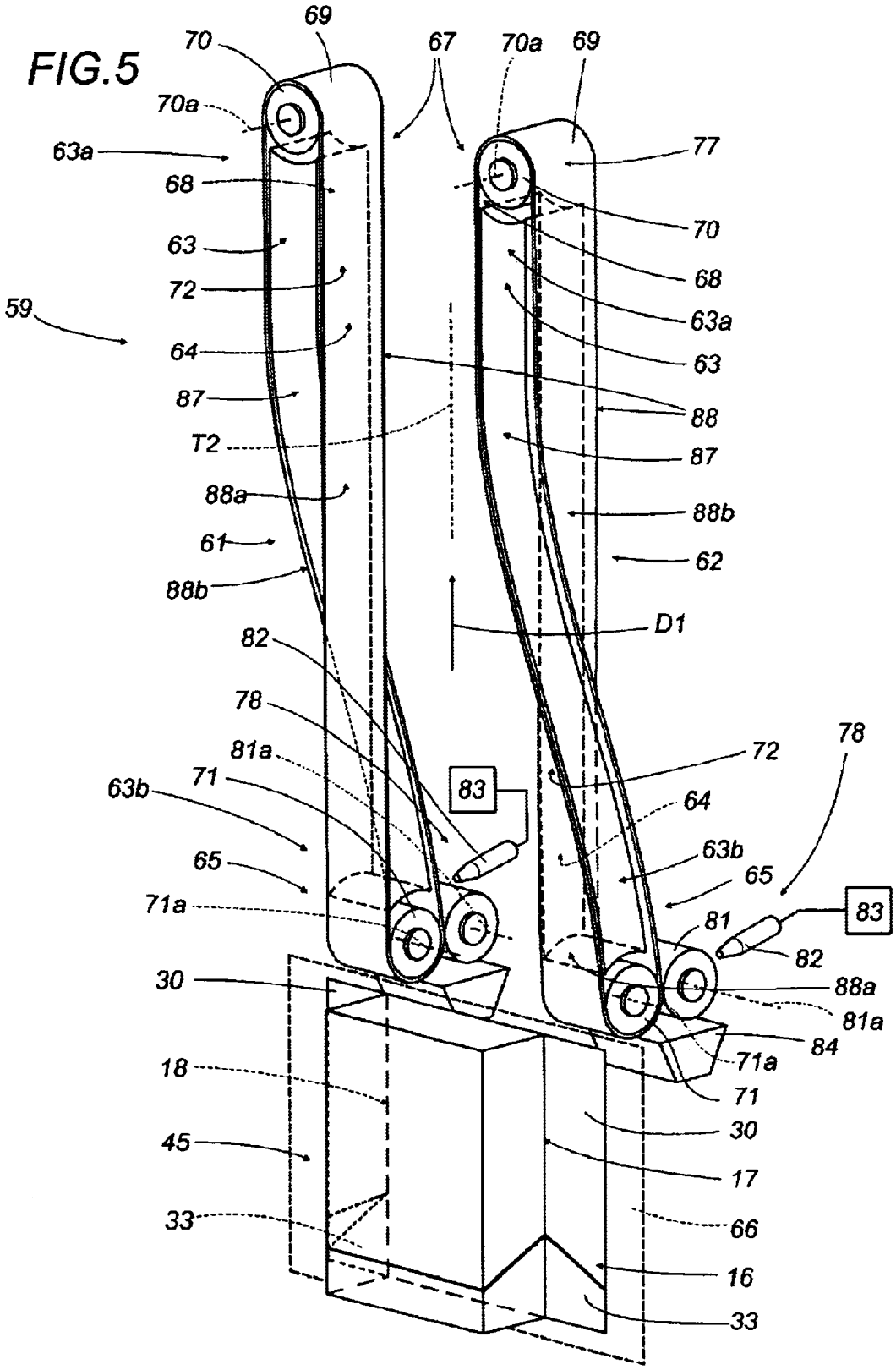
FIG. 5 illustrates a detail of the unit in FIG. 1, viewed in perspective.

As illustrated to better advantage in FIG. 5, the device 59 by which the lateral flaps 30 and 33 are flattened comprises two fixed folders 61 and 62 extending along the aforementioned path T2 followed by the assemblies 45, conveyed by the belt 54 in the direction denoted D1, and mutually opposed on either side of the selfsame path T2.

Each of the two folders 61 and 62 comprises a respective pad 63 extending longitudinally along the conveying path T2 and presenting a surface 64 that winds helically, in part. The pad 63 presents a first top end 63*a* and a second bottom end 63*b* constituting the opposite longitudinal extremities. By reason of the aforementioned helical geometry, the surface 64 presents a bottom end 65 occupying substantially the same plane 66 as that occupied by the active branch 57 of the conveyor 52, and a top end 67 longitudinally remote from and substantially perpendicular to the bottom end 65.

The helical surface 64 of each pad 63 is breasted in sliding contact with the inside face 68 of a belt 69 forming part of a conveyor 88 looped around the selfsame pad 63 and over two idle pulleys 70 and 71 positioned at the corresponding longitudinal ends 63*a* and 63*b* of the pad 63. In particular, the pulley denoted 70 is located at the top end 63*a* and the pulley denoted 71 at the bottom end 63*b*.

The belt conveyor 88 affords an active branch 88*a* extending substantially along the partly helical surface 64 between the two pulleys 70 and 71, and a return branch 88*b* extending along the side of the pad 63 opposite from the active branch 88*a*.

The belt 69 also presents an outer face 72 on the opposite side to the inside face 68, positioned so as to engage the first front longitudinal lateral flaps 30 and 33 of the assembly 45 approaching the folding device 59.

The two pulleys 70 and 71 are rotatable about corresponding axes 70*a* and 71*a* offset mutually at right angles, relative to a straight line extending parallel with the conveying path T2.

Figure 6:
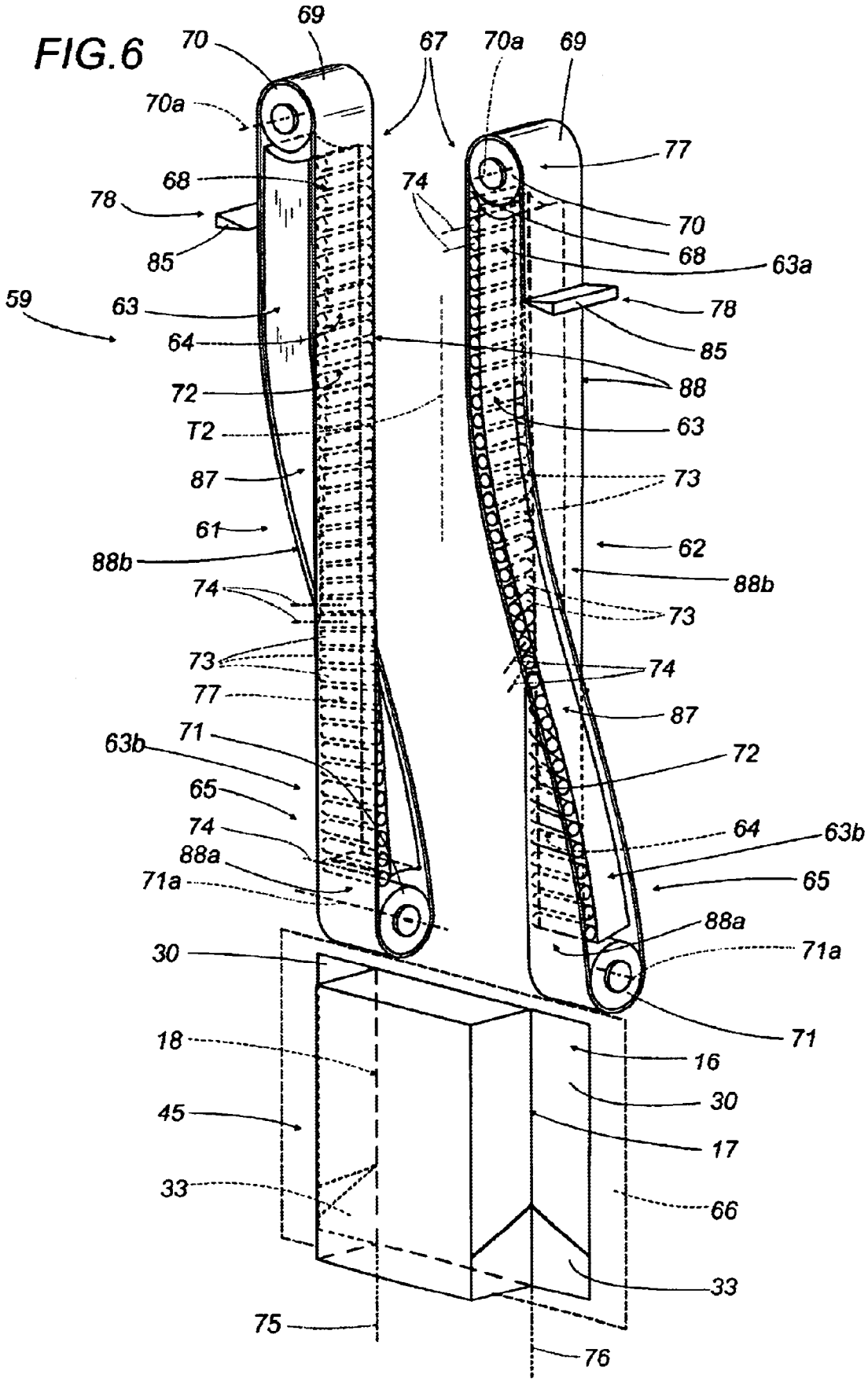
FIG. 6 illustrates a second embodiment of the detail of FIG. 5, viewed in perspective.

In a first alternative embodiment illustrated in FIG. 6, the fixed folders 61 and 62 are furnished with a succession of needle rollers 73 distributed longitudinally along the helical surface 64 of the pad 63 and rotatable thus about respective axes 74. These same axes 74 of rotation coinciding with the rollers 73 of each pad 63 are arranged likewise in such a way as to wind helically about respective trajectories 75 and 76 followed by each of the two longitudinal crease lines 17 and 18 of the blank 16 as the assembly 45 is advanced along the path T2 by the conveyor 52.

The rollers 73 are thus interposed between the pad 63 and the belt 69 so as to minimize resistance to relative sliding motion between the breasted surfaces of the belt and pad 63.

Figure 7:
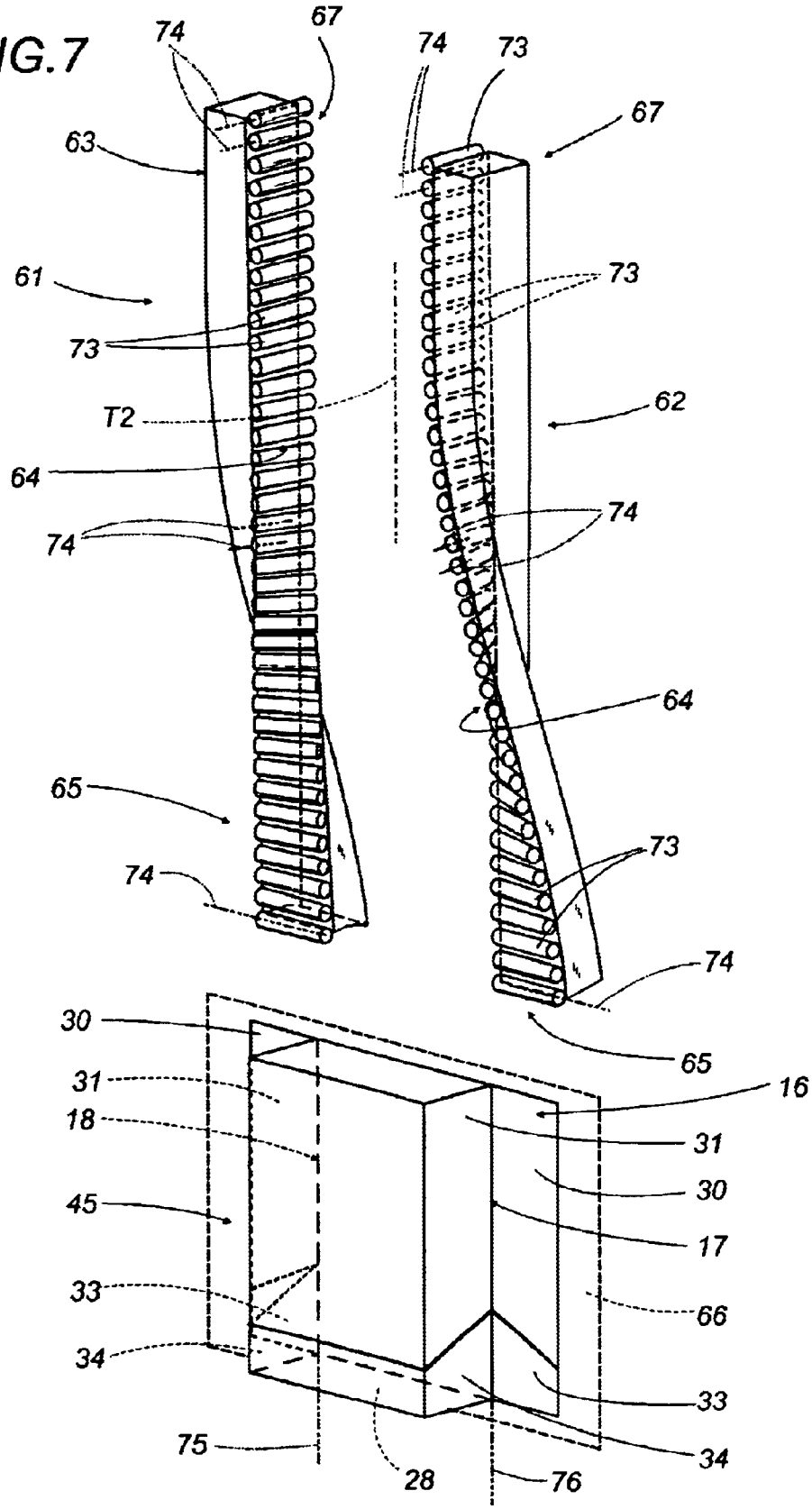
FIG. 7 illustrates a further embodiment of the detail of FIG. 5, viewed in perspective.

Referring to FIG. 7, which illustrates a second alternative embodiment of the fixed folders, each folder 61 and 62 presents a pad 63 of which the helical surface 64 is occupied by a longitudinal succession of rollers 73 designed to engage the first longitudinal lateral flaps 30 and 33 of the assembly 45 in direct rolling contact, without the interposition of a belt 69, as the blank advances along the conveying path T2.

The belt 69 and the rollers 73, whether combined or separately, establish runner means 77 designed to ease the passage of the packet 3 being formed as it passes through the folding device 59.

Figure 8:
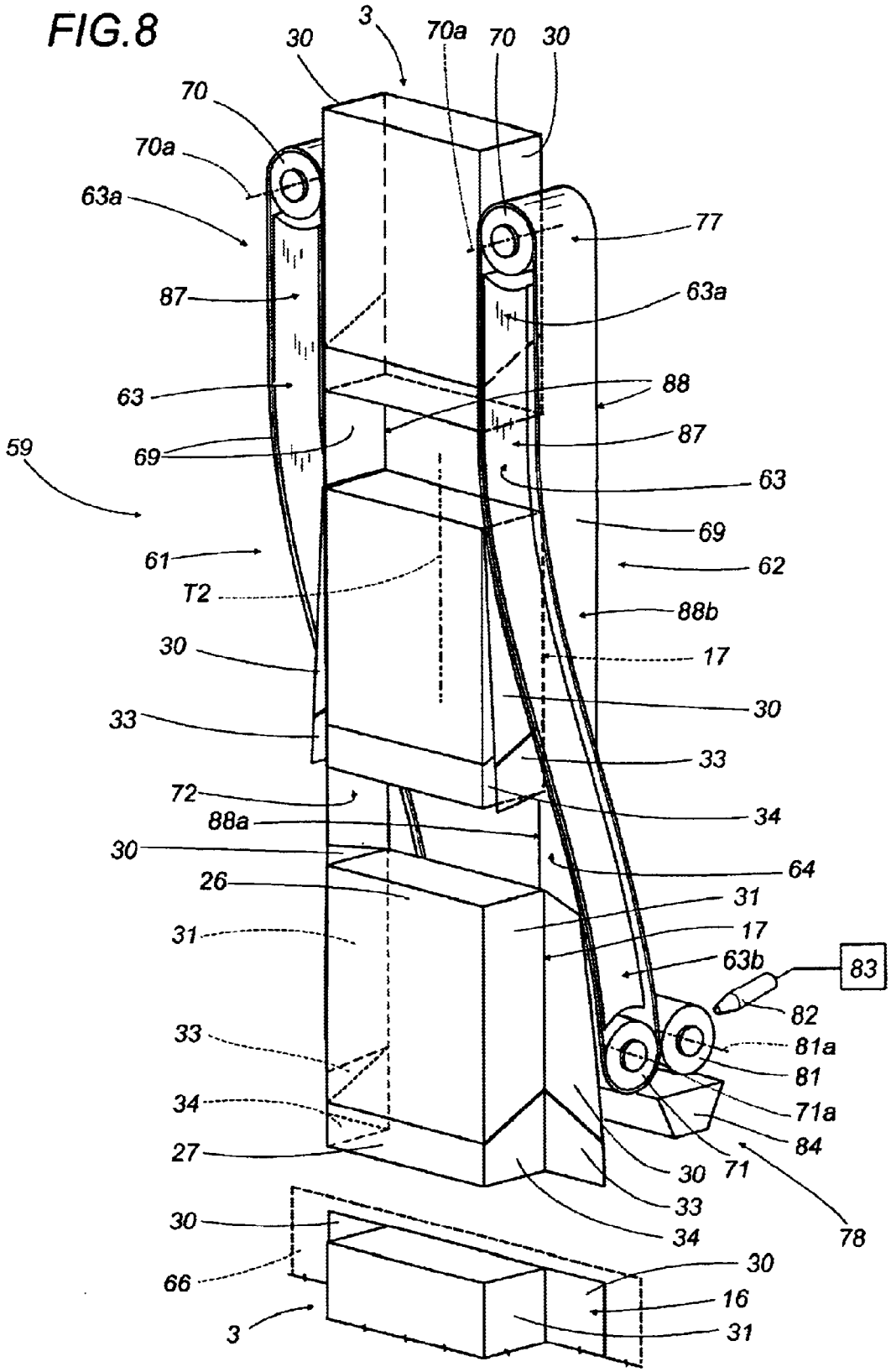
FIG. 8 illustrates the detail of FIG. 5 in a sequence of operating steps, viewed in perspective.
Figure 9:
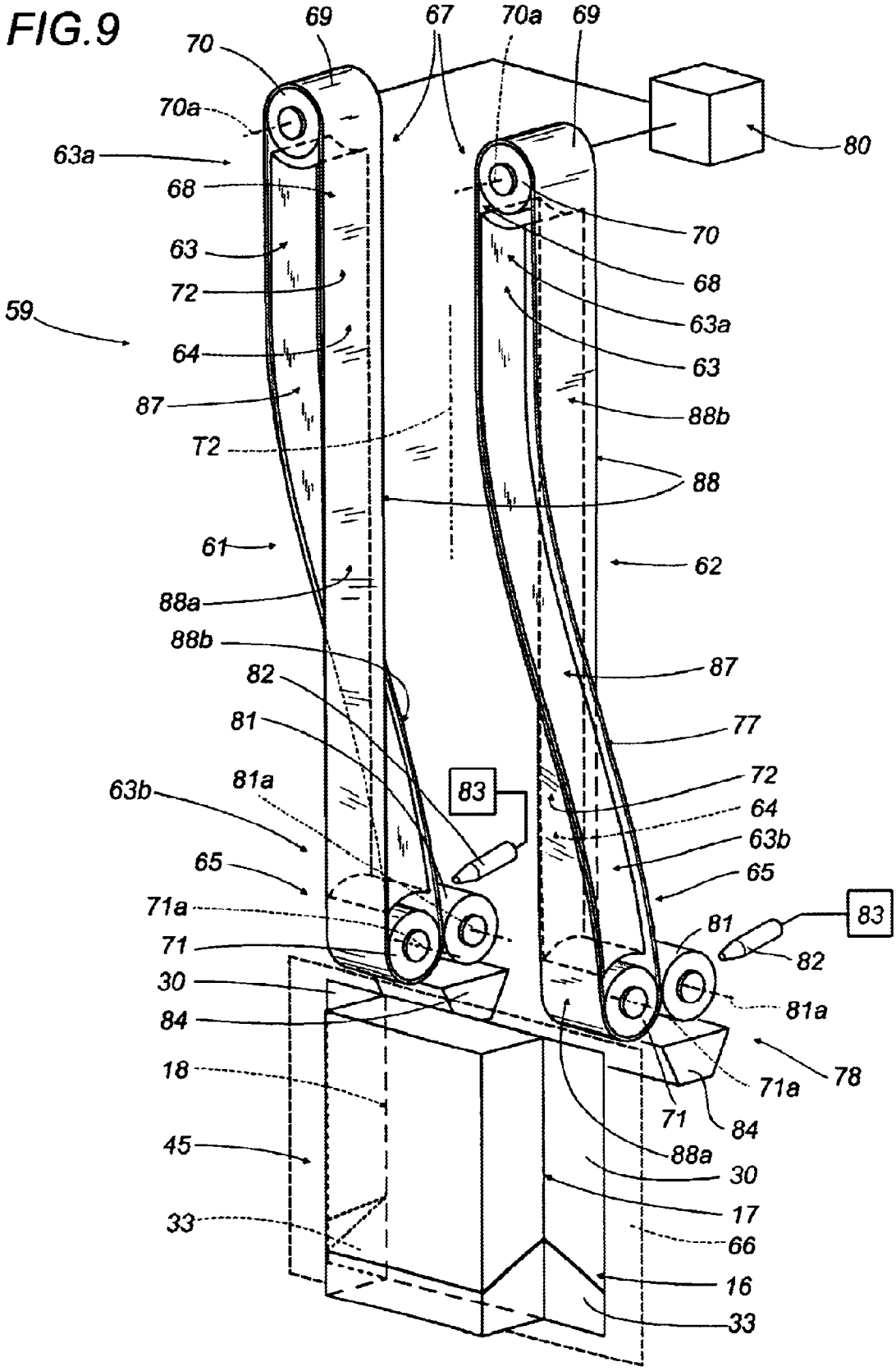
FIG. 9 illustrates a further embodiment of the detail of FIG. 5, viewed in perspective.

More exactly, in the examples of FIGS. 5, 8 and 9, the pads 63 function as guide means 87 for the belts 69, whereas in the example of FIG. 6 it is the pads 63 and the rollers 73 together that make up the guide means 87.

Observing the examples of FIGS. 5, 6, 8 and 9, it will be evident that the effect of investing the runner means 77 with movement in the same direction as that of the assemblies 45 advancing along the conveying path T2, is to minimize or eliminate relative velocity between the folders 61 and 62 and the selfsame assemblies 45 and as a result avoid relative sliding movement, but without diminishing the transverse force acting on the first lateral flaps 30 and 33 as these are brought gradually into contact with the respective second lateral flaps 31 and 34.

As illustrated in FIGS. 5 and 6, the folding device 59 comprises respective cleaning means 78 associated with each folder 61 and 62, of which the function is to remove any residual adhesive that might be left on the outer face 72 of the belt 69 during contact with the assembly 45.

Referring to FIG. 5, the cleaning means 78 for each folder 61 and 62 comprise a roller 81 located alongside the bottom pulley 71 and rotating about a respective axis 81*a* in the opposite direction to the pulley.

Also forming part of the cleaning means 78 are a nozzle 82 from which to spray a cleansing substance at the cleaning roller 81, a device 83 by which the cleansing substance is supplied to the nozzle, and a basin 84 positioned under the cleaning roller 81, in which to catch the cleansing substance after it has acted on the belt 69.

In the example of FIG. 6, the cleaning means 78 are embodied as a scraper blade 85 positioned in contact with the outer face 72 of the belt 69 at a point along the return branch 88*b*, that is to say associated with a part of the folder 61 and 62 not encountered by the assemblies 45 advancing through the folding device 59.

In operation, as discernible from FIG. 1, the flat diecut blanks 16 are supplied in an ordered succession by way of an infeed station 79 to the wrapping wheel 39, through the agency of the first feed unit 42. Each blank 16 is positioned on a relative seat 41 of the wrapping wheel 39, oriented with the two longitudinal crease lines 17 and 18 disposed parallel to the axis 40 about which the wheel 39 rotates.

The previously formed groups 2 of cigarettes, each already associated with a respective frame 15, are supplied in ordered succession to the wrapping wheel 39 by the second feed unit 43.

Each group 2 of cigarettes thus formed is paired with a respective blank 16 at the aforementioned infeed station 44, which lies downstream of the blank infeed station 79 considered in the direction of rotation F1, and positioned with the blank 16 on a seat 41 of the wrapping wheel 39 in such a way as to establish an assembly 45 consisting, as already intimated, in a single group 2 and a corresponding blank 16.

The wrapping wheel 39 rotates in the direction of the arrow F1 and the assemblies 45 are advanced through the folding stations 46 arranged along the periphery of the wheel 39. During the course of its passage through these stations 46, each blank 16 is caused to envelop the respective previously formed group 2 in part.

Thereafter, the assemblies 45 are taken up at the outfeed station 47 by the gripping elements 50 of the transfer wheel 48 and placed each in a relative pocket 51 of the belt conveyor 52, at the moment when the pocket 51 is facing the infeed station 53 of the selfsame conveyor 52 and about to proceed up the active branch 57.

In the course of this transfer step, the gripping elements 50 are caused by drive means not indicated in the drawings to rotate substantially through 90° about corresponding radial axes 50*a,* so that the assemblies 45 will be released to the pockets 51 of the conveyor 52 oriented with the aforementioned longitudinal crease lines 17 and 18 of the blank 16 disposed parallel to the path T2 along which the pockets 51 advance.

Each assembly 45 is directed thereupon by the conveyor 52 through the gumming station 58, which lies downstream of the infeed station 53, relation to the conveying path T2.

The gumming station 58 comprises gumming means of conventional embodiment, not illustrated, by which a predetermined quantity of adhesive substance is applied to the front longitudinal lateral flaps 30 and 33 of the blank 16.

The assemblies 45 are then advanced along the conveying path T2 toward the folding device 59 by which the flaps 30 and 33 will be flattened.

On entering the folding device 59, as discernible from FIG. 5, the assembly 45 encounters the two fixed folders 61 and 62.

In particular, at the moment when the pocket 51 accommodating the assembly 45 draws into alignment with the folding device 59, the opposing pairs of flaps 30 and 33 presented by the blank 16, which occupy a plane lying substantially parallel to the plane 66 occupied by the active branch 57 of the belt 54, will engage in sequence with the outer faces 72 presented by the belts 69 of the two fixed folders 61 and 62 at a point coinciding with the bottom ends 65 of the helical surfaces 64.

Departing from this configuration of engagement between the assembly 45 and the belts 69 of the fixed folders 61 and 62, the lateral flaps 30 and 33 of the blank 16 undergo a series of intermediate folding steps and are caused ultimately to assume the final configuration of the finished packet 3.

In particular, the front longitudinal lateral flaps 30 and 33 of the blank 16 are intercepted by the two fixed folders 61 and 62 and folded square along the respective longitudinal crease lines 17 and 18, entering progressively into contact with the rear longitudinal lateral flaps 31 and 34.

To this end, FIG. 8 illustrates a succession of three assemblies 45 passing through the folding device 59, of which the aforementioned pairs of flaps 30 and 3 are subjected to a series of bending steps by the two fixed folders 61 and 62.

By the time the assembly 45 has passed through the folding device 59 and drawn into alignment with the pulleys 70 at the top ends 63*a* of the pads 63, the blank 16 will envelop the corresponding group 2 of cigarettes completely, constituting a finished packet 3. Each packet 3 completed in this manner is taken up by suitable gripping means of conventional type (not illustrated), and transferred for example to a further station (not illustrated) at which the packet 3 is overwrapped with cellophane.

The operation of the folding device 59 in the example of FIG. 6, where the folders 61 and 62 are equipped with rollers 73 interposed between the belt 69 and the pad 63, is the same as described with reference to FIG. 5.

In the examples of FIGS. 5 and 6, the cleaning means 78 associated with the belt 59 operate in conventional manner and, accordingly, no further description is needed.

Referring to FIG. 7, the assembly 45 is again advanced toward the folding device 59 and engaged by the two fixed folders 61 and 62.

In particular, at the moment when the pocket 51 accommodating the assembly 45 draws into alignment with the folding device 59, the opposing pairs of flaps 30 and 33 presented by the blank 16, which occupy a plane lying substantially parallel to the plane 66 occupied by the active branch 57 of the belt 54, will engage in sequence with the needle rollers 73 on the helical surfaces 64 presented by the pads 63 of the two fixed folders 61 and 62, at a point coinciding with the bottom ends 65 of the selfsame surfaces 64.

Departing from this configuration of engagement between the assembly 45 and the rollers 73 of the fixed folders 61 and 62, the lateral flaps 30 and 33 of the blank 16 undergo a series of intermediate folding steps and are caused ultimately to assume the final configuration of the finished packet 3.

In particular, the front longitudinal lateral flaps 30 and 33 of the blank 16 are intercepted by the two fixed folders 61 and 62 and folded square along the respective longitudinal crease lines 17 and 18, entering progressively into contact with the rear longitudinal lateral flaps 31 and 34.

Advantageously, in a further embodiment of the invention illustrated in FIG. 9, the belts 69 of the two fixed folders 61 and 62 are set in motion by drive means 80 of conventional type coupled to the top pulleys 70 of the respective belts 69 and synchronized with the peripheral velocity of the conveyor belt 54. In this instance the pulleys 70 in question will be live, rather than idle as in the embodiments described previously.

With this drive system, the belts 69 are able actively to pull the assemblies 45 advanced along the conveyor 52, so that if the folding device 59 is positioned at the top end of the conveyor 52 near to the driven second pulley 56, the finished packets 3 can be transferred to the cellophaning station without the aid of gripping means.

Likewise to advantage, in the solution employing rollers 73 that engage the assembly 45 directly, the unit will comprise respective cleaning devices (not illustrated) serving to remove any residual adhesive from the selfsame rollers.

In the examples of FIGS. 6 and 7, the needle rollers 73 are connected to the respective pads 63 of the folders 61 and 62 by means of cages or other such retaining devices substantially identifiable with those used in normal needle bearings available for purchase through commercial channels, which accordingly are neither described nor illustrated.

What is claimed is:

1. A unit for packaging products in respective flat diecut blanks generating packs of substantially parallelepiped appearance, wherein at least one edge portion of the blank is folded in such a way as to establish a respective face of the pack, comprising: means by which to fold the edge portion as the products advance along a predetermined folding path in a predetermined direction, runner means forming part of the folding means capable of movement in a direction concurrent with that of the advancing products and disposed in contact with the edge portion of the blank during the course of the folding step, the folding means including respective means for guiding the runner means, the guide means associated with the runner means at opposite sides of the edge portion of the blank.

2. A unit as in claim 1 for packaging products in respective diecut blanks of which two edge portions are folded to establish relative opposite faces of the pack, wherein the folding means comprise runner means capable of movement in a direction concurrent with that of the advancing products and disposed in contact with the edge portions of the blank during the course of the folding step.

3. A unit as in claim 2, wherein the runner means comprise a plurality of needle rollers generating a relative folding surface that winds helically at least in part, and designed to enter into contact with the edge portions.

4. A unit as in claim 1, wherein the guide means comprise at least one respective fixed pad extending longitudinally along the predetermined path and furnished with a surface winding helically at least in part.

5. A unit as in claim 1, wherein the guide means comprise at least one respective fixed pad extending longitudinally along the predetermined path, furnished with a surface winding helically at least in part and presenting a plurality of rolling elements.

6. A unit as in claim 1, wherein each of the edge portions of the blank is folded by an active branch of a belt conveyor forming part of the runner means, of which the belt is looped around respective pulleys at opposite ends of the folding path and designed to enter into contact with the respective edge portion.

7. A unit as in claim 6, wherein the pulleys of each belt conveyor are disposed with their respective axes set skew one relative to the other.

8. A unit as in claim 7, comprising means by which at least one of two pulleys of each conveyor is power driven.

9. A unit as in claim 6, comprising means by which at least one of the two pulleys of each conveyor is power driven.

10. A unit as in claim 1, wherein the runner means comprise a plurality of needle rollers generating a relative folding surface that winds helically at least in part, and designed to enter into contact with the edge portions.

11. A unit as in claim 1 for packaging products in respective flat diecut blanks of which the edge portions are fixed to predetermined portions of the pack following the interposition of an adhesive substance, wherein the runner means comprise respective cleaning means.

12. A unit as in claim 11, wherein the cleaning means operate on a return branch of each belt conveyor and serve to remove any residual traces of the adhesive substance from the belt.

13. A unit as in claim 12, wherein the cleaning means include a cleaning roller positioned to engage the belt at a point coinciding with one of the pulleys and rotating in the opposite direction to the selfsame pulley.

14. A unit as in claim 12, wherein the cleaning means comprise a scraper blade.

15. A unit as in claim 1, wherein each pack comprises a packet of rigid type with a hinged lid fashioned from a flat diecut blank of substantially rectangular outline referable to a predominating longitudinal axis.

16. A unit for packaging products in respective flat diecut blanks generating packs of substantially parallelepiped appearance, wherein at least one edge portion of the blank is folded in such a way as to establish a respective face of the pack, comprising: means by which to fold the edge portion as the products advance along a predetermined folding path in a predetermined direction, runner means forming part of the folding means capable of movement in a direction concurrent with that of the advancing products and disposed in contact with the edge portion of the blank during the course of the folding step, wherein the runner means comprise a plurality of needle rollers generating a relative folding surface that winds helically at least in part, and designed to enter into contact with the edge portions.

* * * * *